United States Patent [19]

Jenkins

[11] 4,040,555

[45] Aug. 9, 1977

[54] TAG ATTACHING APPARATUS

[75] Inventor: William A. Jenkins, Englewood, Ohio

[73] Assignee: Monarch Marking Systems, Inc., Dayton, Ohio

[21] Appl. No.: 670,797

[22] Filed: Mar. 26, 1976

[51] Int. Cl.[2] ..... B25C 1/00

[52] U.S. Cl. ..... 227/67; 227/76; 227/95

[58] Field of Search ..... 227/67, 76, 95; 112/104; 223/102, 103, 104; 30/243

[56] References Cited

U.S. PATENT DOCUMENTS

| | | | |
|---|---|---|---|
| 893,023 | 7/1908 | Siegel et al. | 30/243 |
| 2,470,834 | 10/1969 | Bone | 227/67 |
| 3,659,769 | 5/1972 | Bone | 227/67 |
| 3,872,806 | 3/1975 | Bone | 227/67 |
| 3,895,753 | 7/1975 | Bone | 227/67 |

*Primary Examiner*—Granville Y. Custer, Jr.
*Attorney, Agent, or Firm*—Joseph J. Grass

[57] ABSTRACT

There is disclosed apparatus for attaching tags and the like to a variety of articles by means of fasteners. The apparatus is provided with a body and a one-piece needle having a piercing end extending outwardly of the body and having an enlarged portion. A bore extends lengthwise of the needle and an elongated first slot in the side of the needle extends into the bore. A second slot in the side of the enlarged portion enables entry of the bar section of a fastener into alignment with and into the bore. A one-piece knife is inserted into the enlarged portion of the needle. When a push rod is actuated the bar section is severed from a fastener assembly utilized by the apparatus, and thereafter the fastener assembly is advanced to bring a bar section of another fastener into the bore.

20 Claims, 15 Drawing Figures

FIG-1
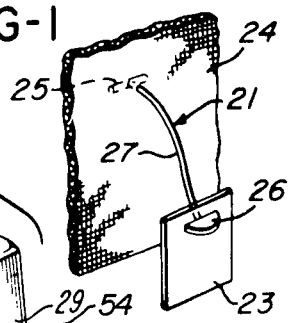
FIG-2
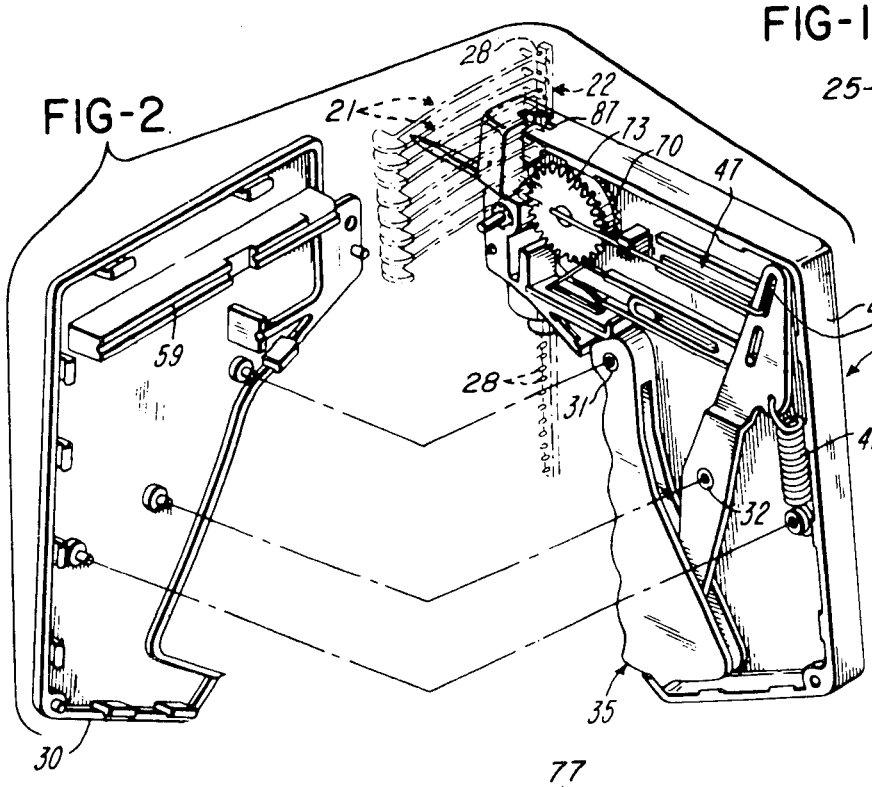
FIG-4
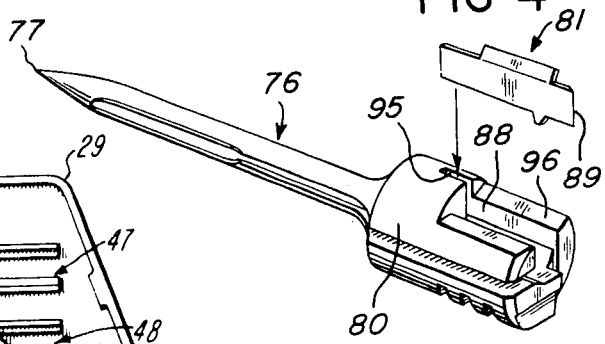
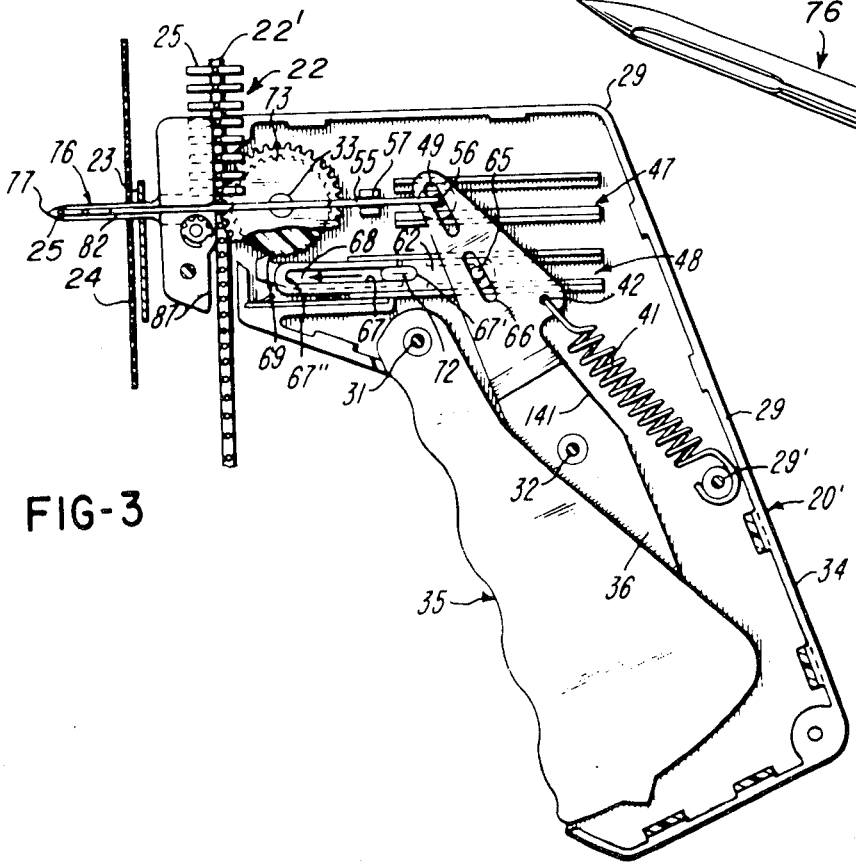
FIG-3

FIG-5
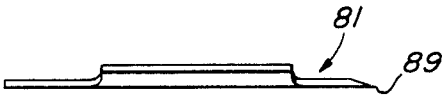
FIG-6
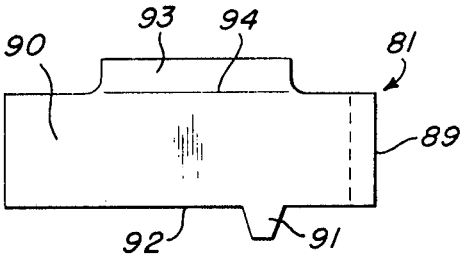
FIG-7
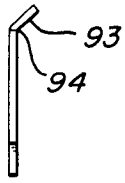
FIG-8
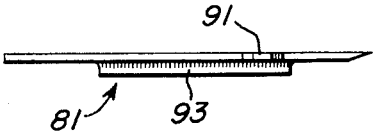
FIG-9
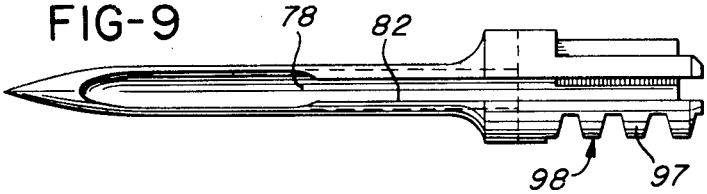
FIG-10
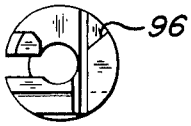
FIG-11
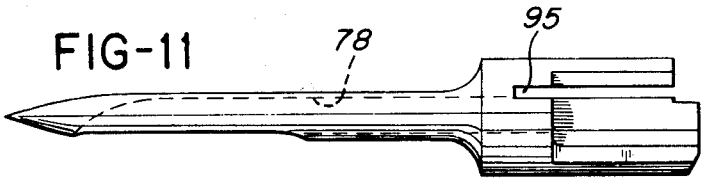
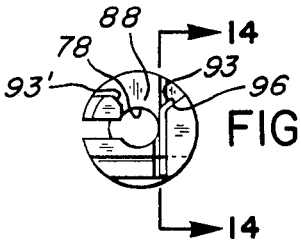
FIG-12
FIG-13
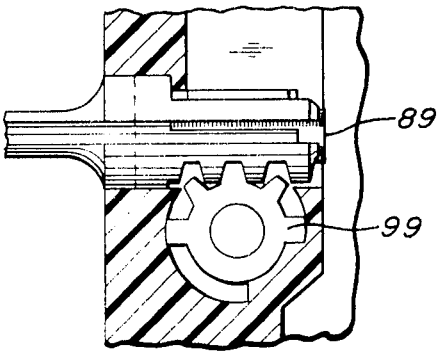
FIG-14
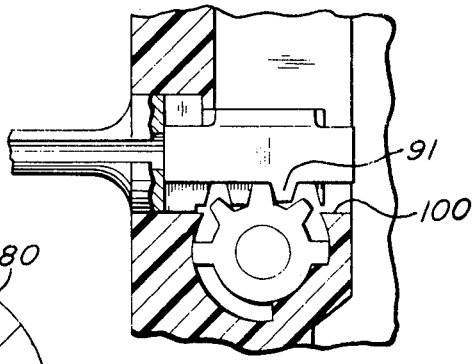
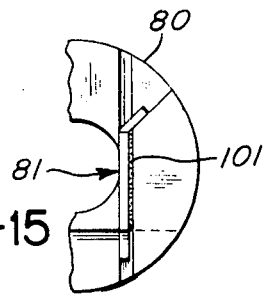
FIG-15

TAG ATTACHING APPARATUS

BACKGROUND OF THE INVENTION

1. Field of the Invention

This invention relates to the art of attachers.

2. Brief Description of the Prior Art

U.S. Pat. No. 3,650,452 to Eugene W. Finke, dated Mar. 21, 1972 discloses an apparatus with which the needle and knife combination of the invention can be utilized. Accordingly, reference can be made to U.S. Pat. No. 3,650,452, the disclosure of which is incorporated herein by reference. Additional examples of prior art attachers are disclosed in U.S. Pats. No. 3,103,666 to Arnold R. Bone, dated Sept. 17, 1963; U.S. Pat. No. 3,470,834 to Arnold R. Bone, dated Oct. 7, 1969 and U.S. Pat. No. 3,924,788 to Akira Furutu, dated Dec. 9, 1975.

SUMMARY OF THE INVENTION

The invention relates to an improved needle and knife arrangement for an attacher. According to the invention the needle is preferably of sturdy construction as in the above-mentioned Finke patent instead of the sheet metal construction as shown in above-mentioned Bone patent. According to the invention, the needle is constructed of a material having the most desirable characteristics for a needle, and the knife is constructed of a material having the most desirable characteristics for a knife. For example, the needle is preferably constructed of a free machining mild-carbon steel to provide reasonable economy of manufacture. In such a steel, some carbon content is required to enable toughness without embrittlement to be achieved during heat treating. The knife, which is inserted into the needle, is preferably relatively thin and blade-like and is constructed of a high carbon spring steel. Such a high carbon steel is suitable for a knife but would be unsuitable for a needle.

The needle has an enlarged portion with an elongated slot extending along the side of the needle and communicating with an elongated bore in the needle. Another slot, in the top side of the enlarged portion of the needle, enables the leading end of a bar section of a fastener to descend into the bore. Still another slot in the enlarged portion receives a portion of the knife. The knife has a converging surface and the enlarged portion also has a converging surface which together guide or cam the bar section into the slot in the top side of the enlarged portion so that the bar section can enter the bore. The converging portion of the knife is supported on a shoulder in the enlarged portion. The enlarged portion is provided with a rack and the knife has a rack tooth which is generally aligned with one of the rack teeth of the enlarged portion. The knife has a generally rectangular, planar portion from which the inclined portion and the rack tooth project. The cutting or knife edge of the knife is provided by one of the short edges of the rectangular portion. If desired the knife can be adhesively or otherwise secured in the enlarged portion.

BRIEF DESCRIPTION OF THE DRAWINGS

FIG. 1 is a perspective view showing a tag attached to a garment by a fastener;

FIG. 2 is an exploded perspective view of a tag attaching apparatus;

FIG. 3 is a side elevational view of a portion of the apparatus, with one body section removed for clarity;

FIG. 4 is an exploded perspective view of a needle and knife utilized in the apparatus;

FIG. 5 is a top plan view of the knife;

FIG. 6 is a side elevational view of the knife;

FIG. 7 is an end elevational view of the knife;

FIG. 8 is a bottom view of the knife;

FIG. 9 is a side elevational view of the needle;

FIG. 10 is an end elevational view of the needle;

FIG. 11 is a top plan view of the needle;

FIG. 12 is a view similar to FIG. 10 but showing the knife in place;

FIG. 13 is an enlarged side elevational partly sectional view of the knife mounted in the needle and the needle and knife mounted in the body;

FIG. 14 is a view similar to FIG. 13 but showing the needle partly in section along line 14—14 of FIG. 12; and FIG. 15 is an enlarged fragmentary view showing how the knife can be adhesively secured in the enlarged portion of the needle.

DESCRIPTION OF THE PREFERRED EMBODIMENTS

Referring to the drawings, there is shown apparatus 20 that uses fasteners generally indicated at 21 which are interconnected to provide a fastener assembly 22. A typical use of a fastener 21 is illustrated in FIG. 1, wherein a tag 23 is shown attached to a garment 24. Each fastener 21 of the assembly 22 includes a bar section 25 and a head section 26 joined by a filament section 27.

The fastener assembly 22 is constructed of plastics material such as nylon or the like and can be molded into a unitary construction such that each of the fasteners 21 is integrally connected to a rod or rail 22' by a connector 28.

With particular reference to FIGS. 2 and 3, the apparatus 20 is shown to include a body 20' constructed of body sections or side plates 29 and 30. The body section 29 has posts or pivots 31, 32 and 33 molded integrally therewith. The body section 29 has a handle portion 34 which is adapted to fit against the palm of the user's hand. An operating member or lever 35 pivotally mounted by the pivot 31 is engageable by the user's fingers. When squeezed, the lever 35 is pivoted counterclockwise and an associated drive lever 36 is also pivoted counterclockwise. A spiral tension spring 41 is connected at one end to a post 29' molded integrally with the body section 29 and at its other end through a hole 42 in the lever 36. The tension spring 41 urges the lever 36 clockwise (FIG. 3) to its rest or initial position shown in FIG. 2. The body section 29 has guides 47 and 48. A slide or guided member 49 is guided by the guide 47 and a slide 62, guided by the guide 48, has an integrally formed pin or projection 65 received in an elongated slot 66 in the lever 36. A push or drive rod 55 has a bent portion or pin 56 which extends into an elongated slot 54 and is received by the guided member 49. The push rod 55 is thus guided at its one end by the slide 49 and along its length by grooves 57 and 59. The slide 62 is shown to have an elongated slot 67. Pawl 68 has a tooth 69 shown to be in engagement with a ratchet wheel 70. The pawl 68 has a pin or boss 72 which is received in the elongated slot 67. The pawl 68 cooperates with the ratchet wheel 70 to provide a pawl and ratchet mechanism. The ratchet wheel 70 is shown to be formed integrally with a feed wheel 73 which engages the connectors 28 to feed the fastener assembly 22 through the apparatus 20.

There is shown a tubular member, specifically a needle, generally indicated at 76 mounted by the body section 29. The needle 76 terminates at a pointed piercing end 77 and has a through bore 78 (FIG. 11 for example) and an elongated slot 82 (which is shown to extend horizontally) in the side of the needle 76 which communicates with the bore 78. The elongated slot 82 is wide enough to allow the filament section 27 adjacent the bar section 25 to pass along the slot 82 while the bar section 25 is passing through the bore 78. The needle 76 has an enlarged portion 80 which receives a knife 81. The push rod 55 is guided in its reciprocating movement in alignment with the bore 78. As the operator 35 is actuated from the position shown in FIG. 2 to the position shown in FIG. 3, the push rod 55 pushes on the end of a bar section 25 which is in alignment with the bore 78 to cause the bar section 25 to be severed from its respective connector 28 by the knife 81. In the position shown in FIG. 3, the pin 72 has reached an abutment 67' formed by one end of the slot 67, thus causing the pawl 68 to move to the left (as seen in FIG. 3) to move the tooth 69 of the pawl 68 over one tooth of the ratchet wheel 70. When the counterclockwise movement of the actuator 35 is complete, the bar section 25 has moved completely through bore 78 to the other side of the material 24 as best shown in FIG. 3. Upon release of the operating lever 35, the return spring 41 returns the lever 36, the actuator 35, the push rod 55, the slide 62 and the pawl 68 to their initial position shown in FIG. 1. Just before these components reach their initial positions, the other end 67" of the slot 67 abuts the pin 72 to cause counterclockwise rotation of the ratchet and feed wheels 70 and 73 (FIGS. 2 and 3), thereby advancing the fastener assembly 22 until the next successive bar section 25 is in axial alignment with the bore 78 in the needle 76. The body section 29 includes a slot or guideway 87 for guiding the fastener assembly 22.

The enlarged portion 80 also includes a slot or cutout 88 in the top side of the enlarged portion 80 into which slightly less than the leading half of the bar section 25 passes as it is advanced by the feed wheel 73. The slot 88 is shown to extend generally vertically. When a bar section 25 has moved into alignment with the bore 78, the respective connector 28 is next adjacent the cutting edge 89 of the knife 81.

The knife 81 is shown to have a generally planar portion 90 having a generally rectangular configuration. The knife edge or cutting edge 89 is formed by one of the relatively short end edges of the portion 90. A rack tooth 91 is joined to and projects from one of the relatively long side edges 92 of the portion 90, and a flange or converging portion 93 is joined to and projects from the other of the relatively long side edges 94 of the portion 90. The knife 81 is inserted into a slot or cutout 95 in the enlarged portion 80. The slot 95 is shown to extend generally vertically and tangentially to the bore 78. The slot 95 opens into the slot 88 and into the bore 78. The slot 95 is also parallel to the bore 78. It is seen that the knife 81 nests in the enlarged portion 80 while the flange 93 is in abutment with a shoulder 96 of the enlarged portion 80. The converging surface of the converging portion 93 and a converging surface or portion 93' of the enlarged portion help guide or cam the leading portion of the bar section 25 into the slot 88 and the bore 78. The shoulder 96 is shown to extend away from the vertical. When the knife 81 is nested in the enlarged portion 80, the tooth 91 is in alignment with tooth 97 of the rack or gear section 98 formed integrally with the enlarged portion. Thus, the pinion 99 meshes with the teeth of the rack 98 and the tooth 91 so that the pinion can be used to drive the knife 81 and the needle 76 into and out of a bore 100 of the body 29. The pinion 99 also cooperates with the tooth 91 to retain and lock the knife 81 in the bore 100.

In an alternative arrangement, the knife 81 can be adhesively secured in the enlarged portion 80 by a suitable adhesive 101, if desired. The layer of adhesive 101 is very thin, but it is shown exaggeratedly thick for purposes of clarity.

Other embodiments and modifications of this invention will suggest themselves to those skilled in the art, and all such of these as come within the spirit of this invention are included within its scope as best defined by the appended claims.

I claim:

1. Apparatus for attaching tags using fasteners, each fastener including a bar section and a button section joined by a filament section, with a connector joined to each bar section, and means for interconnecting the connectors to provide a unitary fastener assembly, the apparatus comprising: a body, a needle having a piercing end extending outwardly of the body and having an enlarged portion, a bore extending lengthwise of the needle, an elongated first slot in the side of the needle communicating with the bore, a second slot in the side of the enlarged portion for enabling entry of a bar section into the bore, means for advancing the bar sections one-at-a-time into alignment with the bore, a knife inserted into the enlarged portion adjacent the bore, the knife having a cutting edge disposed opposite the piercing end, and a push rod engageable with the bar section to effect severing of the bar section from its respective connector by the cutting edge and for thereafter driving the bar section through the bore while the filament section of the fastener extends through the first slot.

2. Apparatus as defined in claim 1, wherein the knife has a generally flat portion having one surface disposed generally tangentially to the bore, the knife having another portion having another surface for guiding the bar section into the second slot.

3. Apparatus as defined in claim 1, wherein the second slot extends generally vertically, the enlarged portion having a shoulder and the knife having a portion extending away from the vertical and in supported relationship by the shoulder.

4. Apparatus as defined in claim 1, wherein the knife has another portion for guiding the bar section into the second slot.

5. Apparatus as defined in claim 1, wherein the knife has a converging portion, and wherein the enlarged portion has a converging portion opposite the converging portion of the knife, the converging portions being effective to guide the bar section into the second slot.

6. Apparatus as defined in claim 1, wherein the enlarged portion has a third slot parallel to the bore in which the knife is received.

7. Apparatus as defined in claim 1, wherein the enlarged portion has a third slot opening into the second slot and into the bore in which the knife is received.

8. Apparatus as defined in claim 1, wherein the enlarged portion has a third slot opening into the second slot and into the bore in which the knife is received, the third slot extending parallel to the bore.

9. Apparatus as defined in claim 1, wherein the enlarged portion includes a rack having at least one rack tooth, the knife including a tooth generally aligned with the rack tooth.

10. Apparatus as defined in claim 1, wherein the knife is adhesively secured to the enlarged portion.

11. For a tag attaching apparatus: a needle having a piercing end and having an enlarged portion, a bore extending lengthwise of the needle, an elongated first slot in the side of the needle communicating with the bore, a second slot in the side of the enlarged portion communicating with the bore, and a knife inserted into the enlarged portion adjacent the bore.

12. The invention as defined in claim 11, wherein the enlarged portion includes a rack having at least one tooth, and the knife includes a tooth generally aligned with the rack tooth.

13. The invention as defined in claim 11, wherein the knife includes a guide portion which provides guided entry of a bar section of a fastener into the second slot.

14. The invention as defined in claim 11, wherein the knife includes a converging portion, and wherein the second slot has a converging portion opposite the converging portion of the knife, the converging portion being effective to guide a bar section of a fastener into the second slot.

15. For a tag attaching apparatus: a needle having a piercing end and having an enlarged portion, a bore extending lengthwise of the needle, an elongated first slot in the side of the needle communicating with the bore, a second slot in the side of the enlarged portion communicating with the bore, a cutout in the enlarged portion communicating with the bore and the second slot, and a knife nested in the cutout and having a cutting edge disposed opposite the pointed end of the needle.

16. For a tag attaching apparatus: a needle having a piercing end and having an enlarged portion, a bore extending lengthwise of the needle, an elongated first slot in the side of the needle communicating with the bore, and a second slot in the side of the enlarged portion communicating with the bore, and a third slot in the enlarged portion opening into the second slot and into the bore, the third slot being adapted to receive a knife.

17. The invention defined in claim 16, wherein the third slot is parallel to the bore.

18. For a tag attaching apparatus: a needle having a piercing end and having an enlarged portion, a bore extending lengthwise of the needle, an elongated first slot in the side of the needle communicating with the bore, a second slot in the side of the enlarged portion communicating with the bore, a cutout in the enlarged portion communicating with the bore and the second slot, the cutout being adapted to receive a knife.

19. For a tag attaching apparatus: a one-piece knife including a first generally flat relatively thin portion having a surface terminating at a knife edge, a rack tooth connected to the first portion, and a second portion having a guide surface inclined with respect to the surface of the first portion.

20. For a tag attaching apparatus: a one-piece knife including a first generally flat relatively thin portion having a surface terminating at a knife edge and a rack tooth connected to the first portion, wherein the first portion is generally rectangular and has a pair of relatively short end edges and a pair of relatively long side edges, the cutting edge being defined by one end edge and the tooth projecting from one side edge, and a second portion joined to the other side edge of the first portion and having a surface inclined with respect to the surface of the first portion.

* * * * *